US011752420B2

(12) United States Patent
deWardener

(10) Patent No.: US 11,752,420 B2
(45) Date of Patent: Sep. 12, 2023

(54) SKI-TRAINING APPARATUS

(71) Applicant: Todd M deWardener, Wakefield, RI (US)

(72) Inventor: Todd M deWardener, Wakefield, RI (US)

( * ) Notice: Subject to any disclaimer, the term of this patent is extended or adjusted under 35 U.S.C. 154(b) by 0 days.

(21) Appl. No.: 17/735,266

(22) Filed: May 3, 2022

(65) Prior Publication Data

US 2022/0401817 A1 Dec. 22, 2022

Related U.S. Application Data

(60) Provisional application No. 63/202,742, filed on Jun. 22, 2021.

(51) Int. Cl.
*A63C 11/22* (2006.01)

(52) U.S. Cl.
CPC ..... *A63C 11/222* (2013.01); *A63C 11/227* (2013.01)

(58) Field of Classification Search
CPC ..... A63C 11/222; A63C 11/227; A63C 5/16; A63C 9/0802; A63C 11/221
See application file for complete search history.

(56) References Cited

U.S. PATENT DOCUMENTS 4,234,202 A * 11/1980 Loffelholz ..... A63C 11/2228 280/820
4,402,529 A * 9/1983 Cavazza ..... A63C 11/22 280/821
4,620,723 A * 11/1986 Joseph ..... A63C 11/222 280/821
5,788,608 A * 8/1998 Wilkinson ..... A63C 11/221 482/74
7,003,849 B2 * 2/2006 Cohen ..... E05D 11/1007 16/436
9,526,974 B2 * 12/2016 Bennert ..... A63C 11/2228
10,286,289 B2 * 5/2019 Owen ..... A63C 11/222
11,524,221 B2 * 12/2022 Bernocchi ..... A41D 19/0037
2018/0256966 A1 * 9/2018 Owen ..... A63C 11/24

FOREIGN PATENT DOCUMENTS

CA 2911899 A1 * 5/2016 ..... A45B 9/02
CN 109453506 A * 3/2019
DE 10325081 A1 * 12/2004 ..... A63C 11/022
DE 102010053107 A1 * 6/2012 ..... A45B 9/02
DE 202012103664 U1 * 12/2012 ..... A45B 9/02
EP 3190920 B1 * 6/2019 ..... A45B 9/02
KR 20020036449 A * 5/2002
KR 20020089064 A * 11/2002
WO WO-0029079 A1 * 5/2000 ..... A45B 9/02

* cited by examiner

*Primary Examiner* — James A Shriver, II
*Assistant Examiner* — Michael T. Walsh

(57) ABSTRACT

An apparatus for training a student to ski is a ski pole that, used in a pair and held laterally, converts to guiding harness. The apparatus is configured as a pair arranged around the student and held by both student and instructor. The apparatus converts to typical-use ski poles when training is complete. The apparatus is configured like a typical-use ski pole, but articulated with a ratchet joint that enables arrangement around the student.

3 Claims, 6 Drawing Sheets

SKI-TRAINING APPARATUS

TECHNICAL FIELD

The invention relates in general to training apparatuses for skiing and more particularly to a method and apparatus for teaching downhill-skiing skills to a young person.

BACKGROUND

Methods and training aids for teaching young students to ski commonly comprise harness-type apparatuses that connect instructor to student by use of reins or straps, involving an instructor skiing behind the tethered student. Separate from apparatuses, a common method of instruction involves an instructor skiing backward in front of the student. Other common practices include guiding a student between the skis of the instructor.

Harness-type training apparatuses have a short life span because training usually is completed in a few sessions. Having no other use, the training harness ends up discarded. A training apparatus that is convertible to a usable tool, such as a ski pole, would provide extended usefulness.

SUMMARY

In an example embodiment, an apparatus for training a student to ski is a set of novel ski poles that convert to a temporary guiding support that is arranged around the student and held by both student and instructor. The ski poles are adjustable in length and articulated with a ratchet joint that enables configuring the apparatus to fold in front of the student. A ski pole is normally held longitudinally. The embodiment is instead held laterally, with the student holding the distal pole grips and the instructor holding grips at proximal pole ends, effectively hitching instructor to student.

Push-button ratchet joints near the distal grips are for angling the poles to an angle between 45 and 90 degrees. Distal pole grips employ an embedded magnet at one of the terminal ends to connect the pole ends to form a handle that the student holds during instruction. The magnets are of a strength to allow release in the event of the student's fall. As a student falls and pushes down on the grips, magnets are twisted in such a manner as to allow for easy disengagement. While holding the lower, proximal end of the apparatus, an instructor guides the student's movement from behind.

Once the student is able to ski on their own, the joint may be straightened and the poles used normally.

DESCRIPTION

Figure 1:
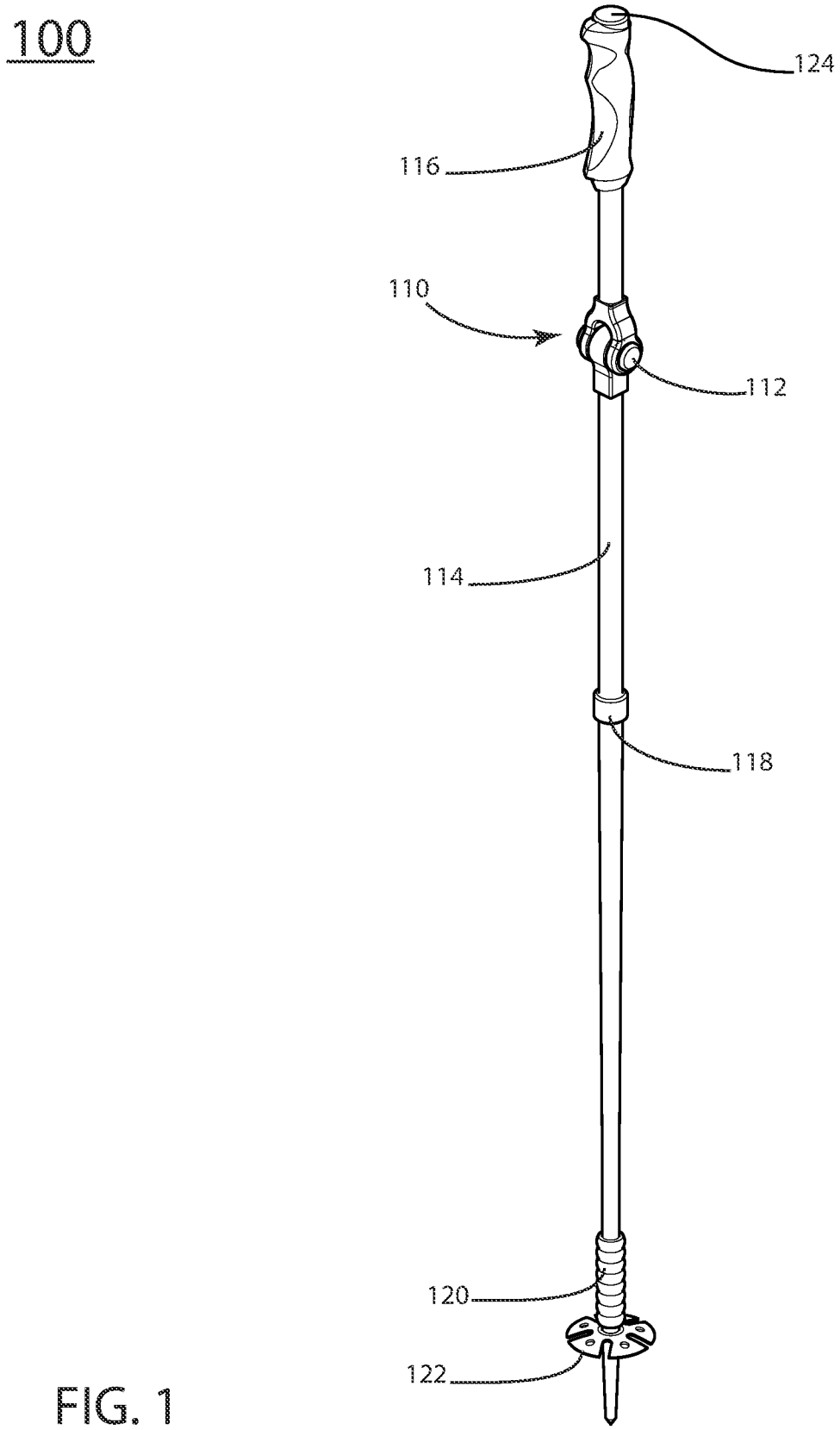
FIG. 1 is a perspective view of an example embodiment of the present disclosure.
Figure 2:
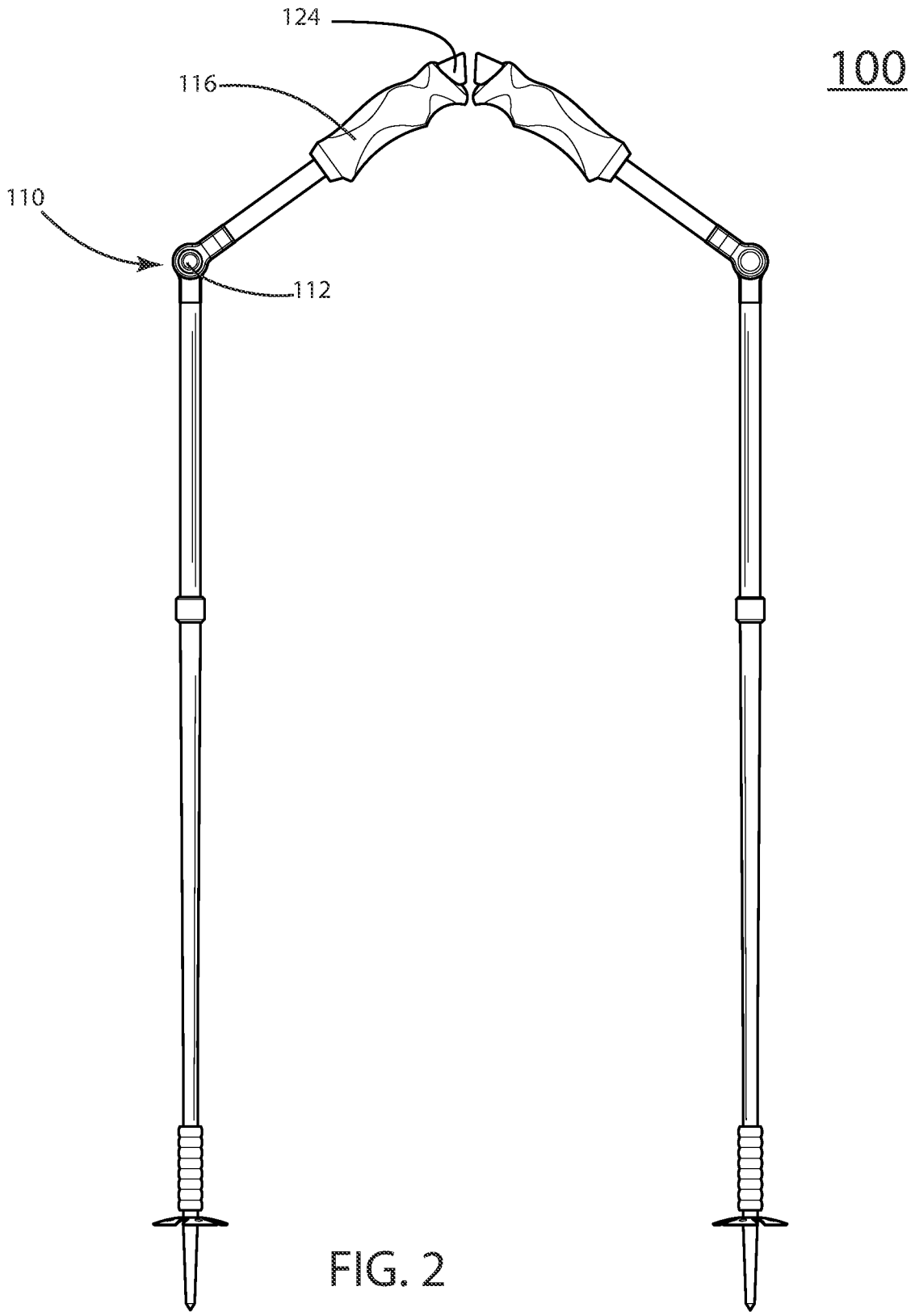
FIG. 2 is a front view of thereof.

FIG. 1 shows a perspective view of an example embodiment 100. A ski pole 100 has an extendable shaft 114 with a lock 118. One skilled in the art is familiar with extendable poles and common locking mechanisms. The ski pole 100 is articulated about a ratcheting joint 110 that has a release button 112. One skilled in the art is familiar with joints that rotate on an axis and lock into various positions. A distal grip 116 has a magnet 124 embedded in the top of the grip 116. The magnet 124 pivots so as to meet a mating magnet as shown in FIG. 2. A second grip 120 is affixed to the base of the shaft 114, proximal to a common ski-pole basket 122.

FIG. 2 shows a pair of ski poles 100 angled at approximately 45°. The ratcheting joint 110 is released by depressing the release button 112; moving the joint into position; then releasing the release button 112. Magnets 124 rotate on their pivoting mounts in grips 116, to meet as shown. One skilled in the art is familiar with ball joints and other pivoting mechanisms that allow for flat surfaces such as magnets 124 to mate in surface-to-surface contact.

Figure 3:
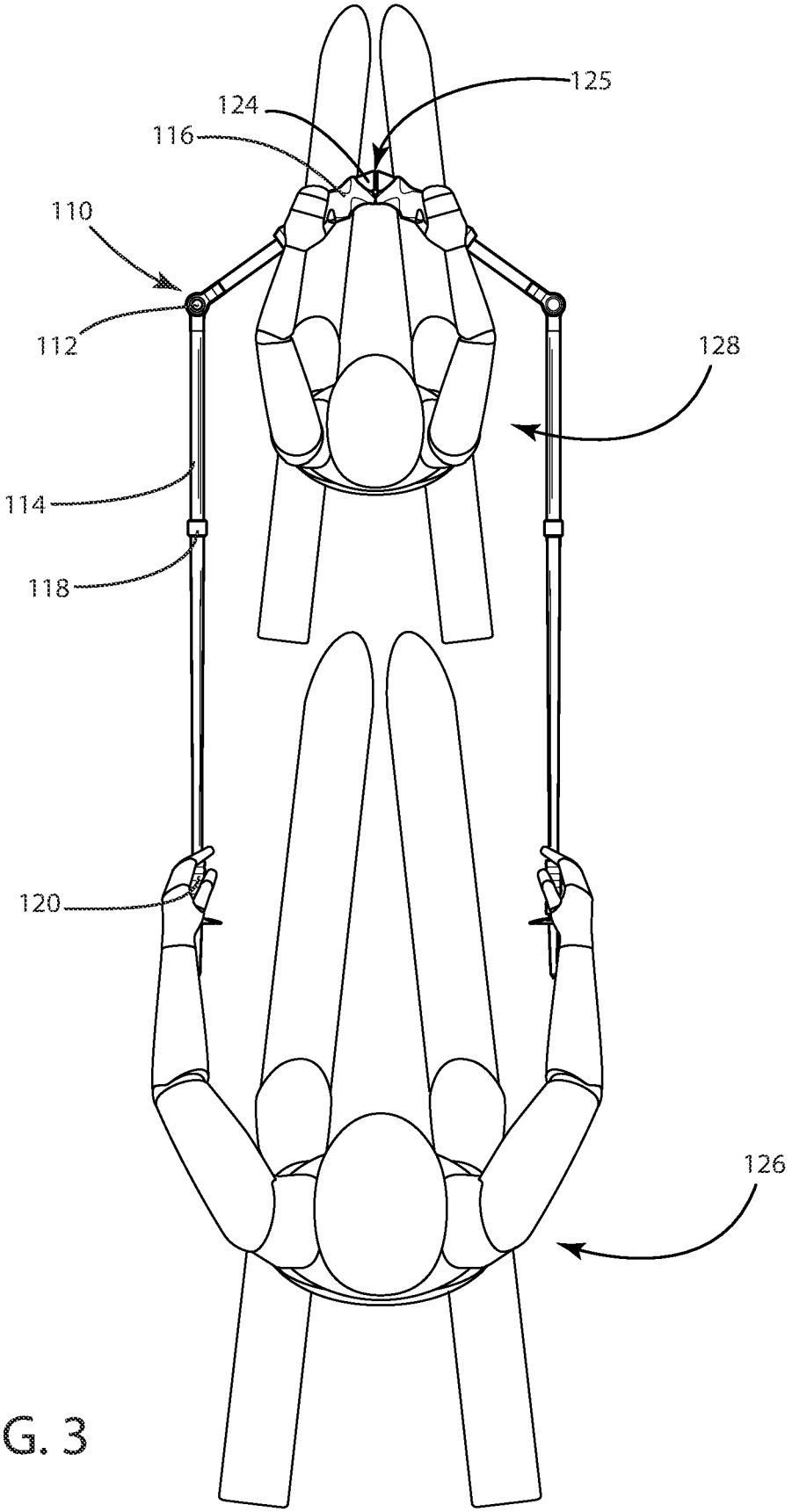
FIG. 3 is a top view of the example embodiment shown in use.

FIG. 3 shows a set of poles used by an adult instructor 126 and a child student 128. The poles are symmetrical and like components have like reference numbers. One pole is referenced. The instructor 126 holds the proximal second set of grips 120. The pole shafts 114 are adjusted about locking mechanisms 118 to a length that allows the student 128 to ski in front of the instructor 126. The ratcheting joints 110 are pivoted about release button 112 and are locked in an approximately 45° angle. The student 128 holds the terminal grips 116 that are joined together by magnets 124. The magnets 124 are rotated in their sockets so that their top surfaces meet 125.

Figure 4:
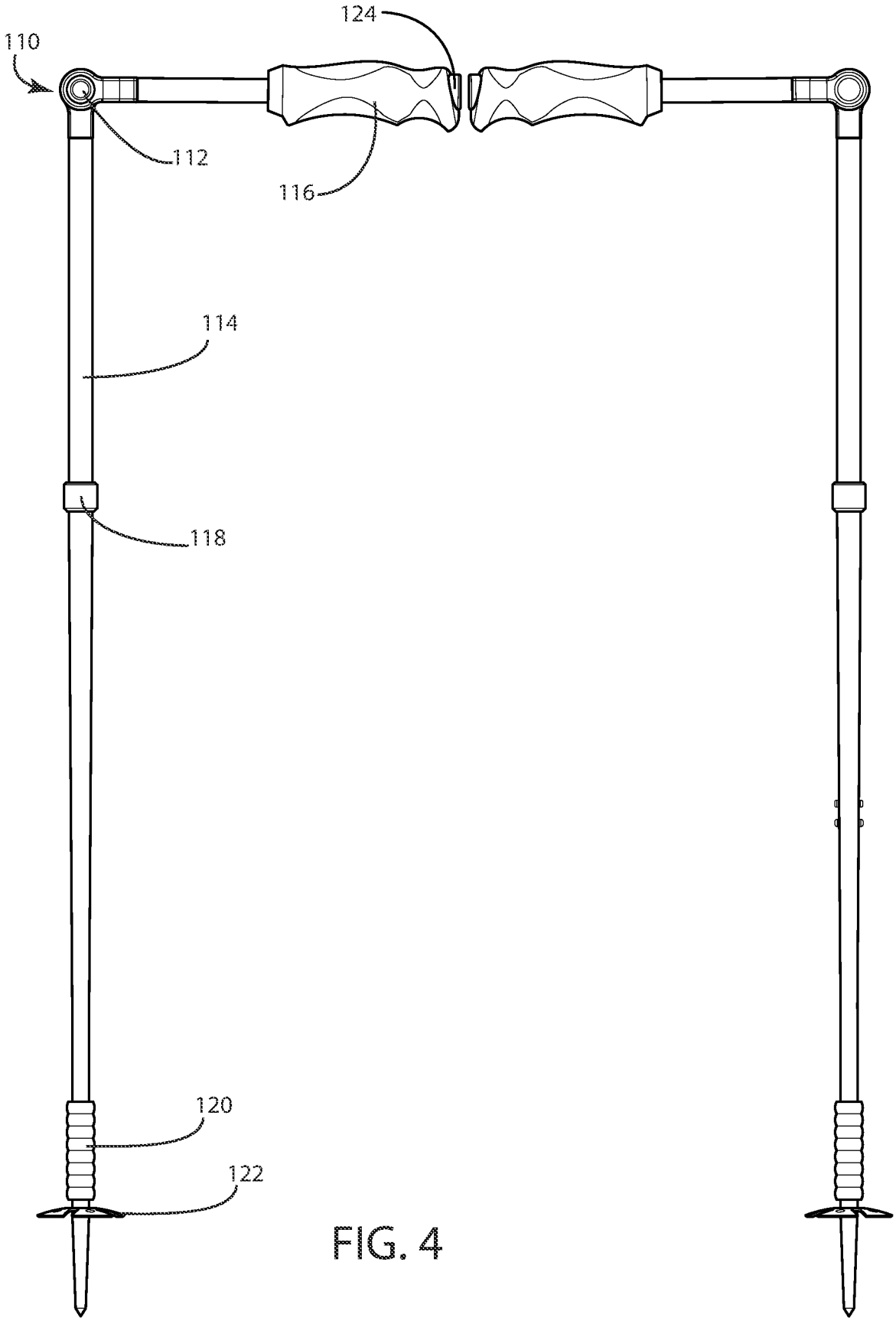
FIG. 4 is a front view of a configuration of the example embodiment.

Referring to FIG. 4 a pair of ski poles 100 are each bent at approximately a 90° angle. The ratcheting joint 110 is released by depressing the release button 112 and moving the joint into position and then releasing the release button 112. Magnets 124 rotate on their pivoting mounts in grips 116, to meet as shown.

Figure 5:
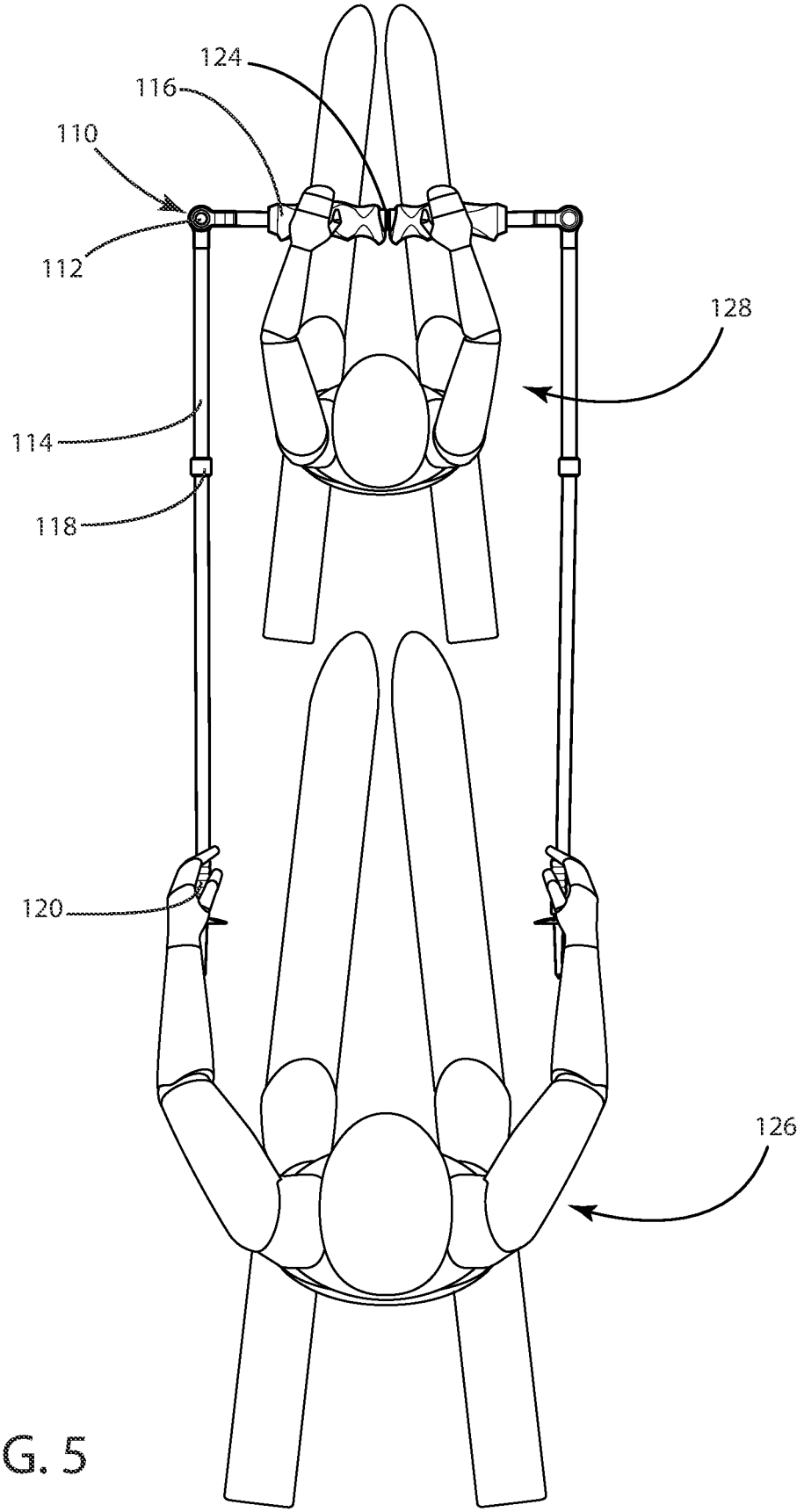
FIG. 5 is a top view of the example embodiment of FIG. 4, shown in use.

Referring to FIG. 5 a set of poles are shown used by an adult instructor 126 and a child student 128. The poles are symmetrical and like components have like reference numbers. One pole is referenced. The instructor 126 holds the proximal, second set of grips 120. The pole shafts 114 are adjusted about locking mechanisms 118 to a length that allows the student 128 to ski in front of the instructor 126. The ratcheting joints 110 are pivoted about the release button 112 and are locked in an approximately 90° angle. The student 128 holds the distal grips 116 that are joined together by magnets 124. The magnets 124 are rotated in their sockets so that their top surfaces meet 125. If the student falls, the magnets release so that the student is not harmed by the poles in the event of a fall.

Figure 6:
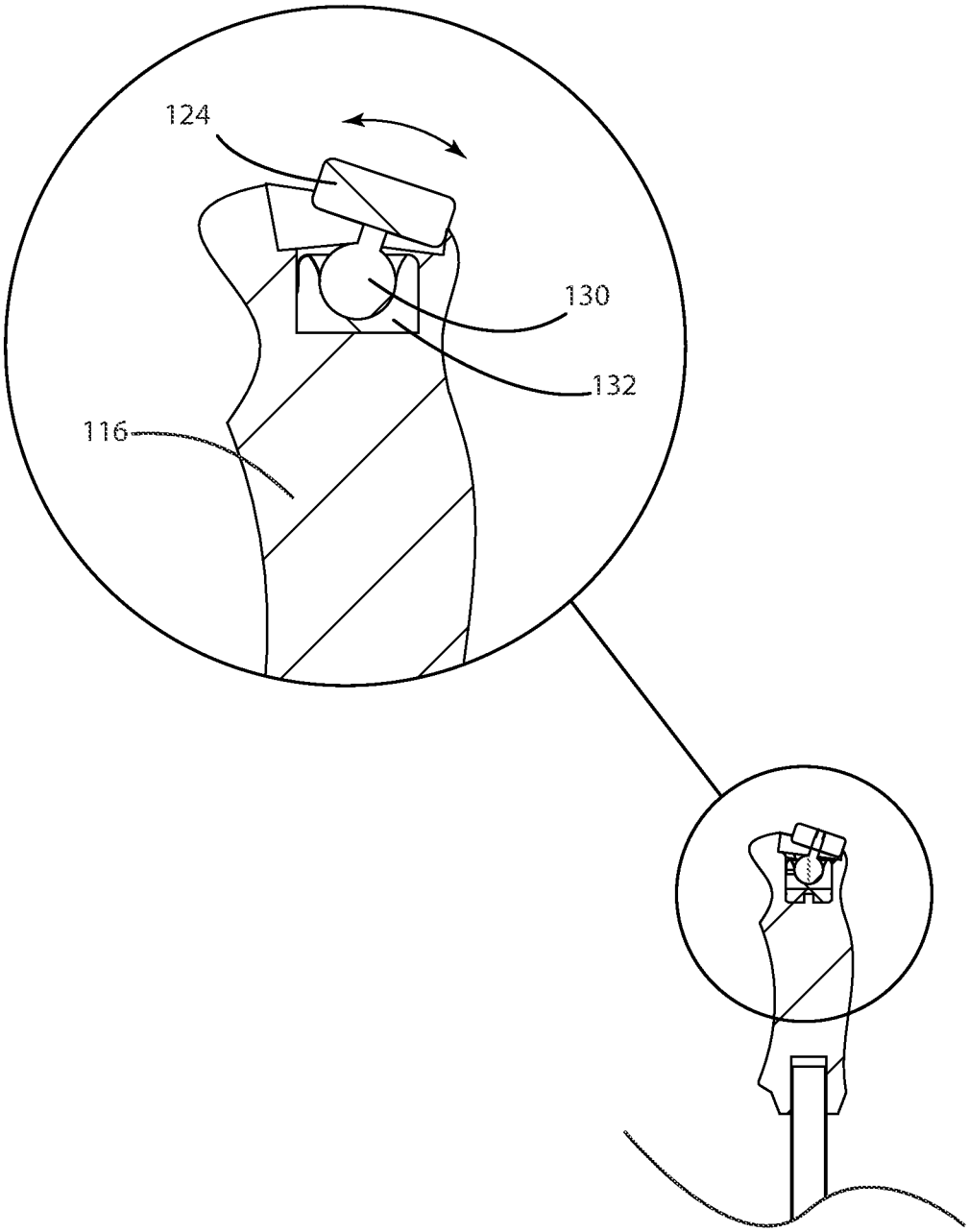
FIG. 6 is a partial cross section view depicting a ball and socket engaged with a magnet in a hand grip.

Referring to FIG. 6 a magnet affixed to a ball and socket is depicted in the illustration. A socket 132 is affixed in the handle 116. A ball 130 pivots within the socket 132 and is further engaged with the magnet 124. Each magnet in a pair is able to pivot as shown so that they may mate face-to-face as shown in FIG. 2.

These embodiments should not be construed as limiting.

The invention claimed is:

1. An apparatus for assisting in training a student to ski comprising:

a ski pole having a first end and a second end; and a hand grip having a top and a bottom, said bottom engaged with said ski pole at said first end: and a magnet fixedly engaged with said top of said hand grip; and an articulated joint proximal to said first end; and a hand grip, a basket and a point at said second end; and providing a pair of said ski poles, a first ski pole of the pair of ski poles may be bent at a first articulated joint; and a second ski pole of the pair of ski poles may be bent at a second articulated joint; and said first ski pole and said second ski pole may be removably engaged end-to-end proximal to the top of said hand grip on said first ski pole and to the top of said hand grip on said second ski pole, by said magnet on said first ski pole hand grip and said magnet on said second ski pole hand grip; wherein a student may hold the hand grip on said first end of said first ski pole and said second ski pole and a person training the student may hold said hand grip on said second end of said first ski pole and said second ski pole.

2. The apparatus of claim 1 further comprising:

a socket fixedly engaged with said hand grip top; and a ball fixedly engaged with magnet and pivotally engaged with said socket; wherein the ball and socket allow said magnet on said first ski pole of said pair of said ski poles to meet a second magnet on said second ski pole of said pair of said ski poles to assist the student in holding the hand grips.

3. The apparatus of claim 1, further comprising:

a locking mechanism engaged with said articulated join to maintain an angle between 45° and 90°.

* * * * *